United States Patent [19]

van Esdonk et al.

[11] Patent Number: 4,625,142

[45] Date of Patent: Nov. 25, 1986

[54] METHODS OF MANUFACTURING A DISPENSER CATHODE AND DISPENSER CATHODE MANUFACTURED ACCORDING TO THE METHOD

[75] Inventors: Johannes van Esdonk; Jacobus Stoffels, both of Eindhoven, Netherlands

[73] Assignee: U.S. Philips Corporation, New York, N.Y.

[21] Appl. No.: 477,106

[22] Filed: Mar. 21, 1983

[30] Foreign Application Priority Data

Apr. 1, 1982 [NL] Netherlands ..... 8201371

[51] Int. Cl.[4] ..... H01J 9/04

[52] U.S. Cl. ..... 313/346 DC

[58] Field of Search ..... 445/50, 51; 313/346 DC, 313/346 R

[56] References Cited

U.S. PATENT DOCUMENTS

| | | | |
|---|---|---|---|
| 3,538,570 | 11/1970 | Koppius | 445/50 |
| 3,719,856 | 3/1973 | Koppius | 313/346 DC |
| 4,007,393 | 2/1977 | Van Stratum et al. | 313/346 R |
| 4,350,920 | 9/1982 | Bertens | 313/346 R |

FOREIGN PATENT DOCUMENTS

| | | | |
|---|---|---|---|
| 2558784 | 7/1976 | Fed. Rep. of Germany | 313/346 |
| 2604765 | 9/1976 | Fed. Rep. of Germany | 313/346 |
| 439028 | 1/1975 | U.S.S.R. | 313/346 |

*Primary Examiner*—Kenneth J. Ramsey

*Attorney, Agent, or Firm*—Robert J. Kraus

[57] ABSTRACT

A dispenser cathode body is manufactured from a sintered metallic powder. A large scandium oxide concentration is provided beneath an emissive surface of the body, resulting in increased life, increased current density, and decreased sensitivity to ion bombardment.

9 Claims, 3 Drawing Figures

METHODS OF MANUFACTURING A DISPENSER CATHODE AND DISPENSER CATHODE MANUFACTURED ACCORDING TO THE METHOD

BACKGROUND OF THE INVENTION

The invention relates to a few methods of manufacturing a dispenser cathode, comprising barium and scandium compounds for dispensing barium to the emissive surface of a cathode body which consists substantially of a high melting-point metal or alloy.

There are, in addition to the oxide cathode, three other main types of dispenser cathodes, the L-cathode, the pressed cathode and the impregnated cathode. A survey of these three types of dispenser cathodes is described in Philips Technical Review, Volume 19, 1957/58, No. 6, pp. 177–208, which article is incorporated herein by reference. The characteristic feature of dispenser cathodes is that there is a functional separation between the electron-emissive surface and on the other hand a store of the emissive material which serves to produce a sufficiently low work function of said emissive surface. The emission of an L-cathode takes place from the surface of a porous metal body, the work function of which is reduced by adsorbed Ba and BaO. Behind the porous body the L-cathode has a storage space in which a mixture of tungsten powder and emissive material (for example barium calcium aluminate) is present. A pressed cathode and an impregnated cathode have a slightly different construction in which the storage space is absent and the emissive material is present in the pores of the porous metal body. A pressed cathode is formed by pressing a mixture of metal powder, for example tungsten and/or molybdenum powder and emissive material. An impregnated cathode is obtained by impregnating a pressed and sintered porous metal body with the emissive material.

A method similar to the one described in the opening paragraph is disclosed in U.S. Pat. No. 4,007,393. This Patent describes a porous metal body which is pressed from tungsten powder, sintered and which has a density of approximately 80% of the theoretical density. It is impregnated with a mixture which comprises 3% by weight of scandium oxide in addition to barium oxide, calcium oxide and aluminium oxide. The resulting cathode can provide a current with a current density of 5 A/cm$^2$ at an operating temperature of 1000° C. for approximately 3000 hours.

U.S. Pat. No. 3,358,178 describes a pressed dispenser cathode the cathode body of which is composed of tungsten powder and barium scandate ($Ba_3Sc_4O_9$). The barium scandate forms 5 to 30% of the overall weight of the cathode body. With such a cathode a current density is obtained of 1.5 to 4 A/cm$^2$ at 1000° to 1100° C. for a few thousand hours. During manufacture, such a cathode body must be sintered at approximately 1550° C. for approximately 5 minutes after pressing. A higher sintering temperature would result in decomposition of the barium scandate. As a result of this comparatively low sintering temperature, the porosity of the sintered cathode body becomes so large, however, that the barium present easily diffuses towards the surface and then evaporates. Furthermore, the quantity of barium in the cathode is comparatively small as a result of which the life of the cathode is detrimentally influenced. This is the case certainly at operating temperatures above 985° C.

SUMMARY OF THE INVENTION

It is an object of the invention to provide a few methods of manufacturing cathodes which in addition to a large current density have a longer life than the pressed cathodes with scandium oxide known so far and which are less sensitive to sputtering of scandium oxide caused by ion bombardment than the impregnated cathodes with scandium oxide known so far.

A first method of manufacturing a dispenser cathode of the type described in the opening paragraph is characterized according to the invention in that the cathode body (the matrix) is pressed from a quantity of metal powder which is mixed at least partly with scandium oxide, after which the body is sintered and the cathode is provided with emissive material.

The metal powder may be, for example, tungsten and/or molybdenum or an alloy of the two metals. According to the invention, by first sintering the mixture of scandium oxide ($Sc_2O_3$) and metal powder at, for example, 1900° C. for approximately 1 hour and only then providing the cathode with emissive material, it is possible to manufacture cathodes in which much of the scandium oxide is present at the surface. The provision with emissive material may be done either by impregnating the porous metal body with, for example, barium calcium aluminate having the (composition for example $5BaO.2Al_2O_3.3CaO$) or by providing the storage space of the L-cathode with a pellet which comprises barium calcium aluminate. Cathodes having a continuous average current density of 10 A/cm$^2$ at 985° C. measured in a cathode ray tube, were manufactured by means of the method according to the invention. In a diode measuring arrangement with a cathode-anode spacing of 0.3 mm, a current density of approximately 100 A/cm$^2$ was measured at 985° C. and with a pulse load of 1000 Volts. The manufactured cathodes moreover had a longer life and were less sensitive to ion bombardment than the cathodes known so far. According to the invention it is also possible that only a part of the metal powder from which the porous metal body is pressed, is mixed with scandium oxide from which part a surface layer is formed. In impregnated cathodes this has the advantage that the part of the cathode body which does not comprise scandium oxide can have a greater porosity than the cathode bodies of the impregnated cathodes used so far as a result of which more impregnant (emissive material) can be incorporated. In this manner it is also possible to manufacture impregnated and L-cathodes on which much scandium oxide is present. The quantity of scandium oxide in the mixture of scandium oxide and metal powder is preferably 2 to 15% by weight.

According to the invention it is also possible to obtain much scandium oxide in the cathode surface when the cathode body is pressed from a quantity of metal powder, is then sintered, a layer of scandium oxide is then provided on the surface of the cathode body, after which the cathode body with the layer of scandium oxide present thereon is sintered, after which the cathode is provided with emissive material. The second sintering step may be carried out at approximately 1900° C. It is possible for example, to provide a layer of scandium oxide on a sintered porous metal body by applying a scandium oxide suspension (comprising scandium oxide and alcohol) to the body. This permits for example cylindrical cathodes to be manufactured in a simple manner.

Still another method of manufacturing a dispenser cathode according to the invention is characterized in that the cathode body is pressed from a quantity of metal powder and a surface of the body is then provided with a layer of scandium oxide, after which the body is sintered and the cathode is then provided with emissive material.

All the methods according to the invention described make it possible to provide a large scandium oxide concentration compared with the known cathodes in the cathode surface with the afore-mentioned advantages. The methods may be used both in L-cathodes and impregnated cathodes.

BRIEF DESCRIPTION OF THE DRAWING

Some embodiments of the invention will now be described in greater detail, by way of example, with reference to a drawing in which.

DESCRIPTION OF THE PREFERRED EMBODIMENTS

EXAMPLE 1

Figure 1:
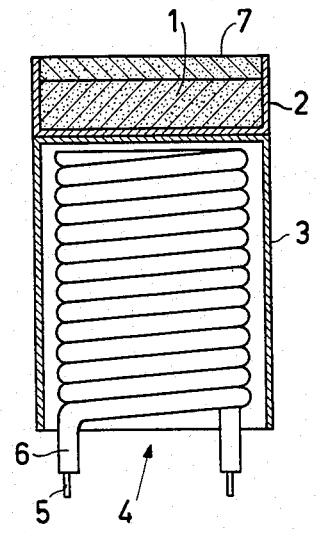
FIG. 1 is a longitudinal sectional view of a cathode according to the invention.

FIG. 1 is a longitudinal sectional view of a cathode according to the invention. A cathode body 1 is pressed from tungsten powder on which before compression a 0.2 mm thick layer of a mixture of 95% by weight of tungsten powder and 5% by weight of scandium oxide is provided. After compression and sintering the cathode body consists of an approximately 0.1 mm thick scandium oxide-containing porous tungsten layer having a density of approximately 83% of the theoretical density on a 0.7 mm thick porous tungsten layer having a density of approximately 75% of the theoretical density. The density of the whole cathode body of the cathode known so far was approximately 80% of the theoretical density, so that the cathode body manufactured according to the invention can comprise more impregnant (emissive material). The cathode body 1 is then impregnated with barium calcium aluminate (e.g. $5BaO.2Al_2O_3.3CaO$ or $4BaO.1Al_2O_3.1CaO$). The impregnated cathode body 1 is then pressed in a holder 2 and welded to a cathode shaft 3. A spiral-like cathode filament 4 consisting of a metal spirally wound core 5 and an aluminium oxide insulation layer 6 is present in the cathode shaft 3. Because there is a comparatively high concentration of scandium oxide in the emissive surface 7 an emission of approximately 100 $A/cm^2$ at 985° C. is obtained with a pulse load at 1000 Volts in a diode with a cathode-anode spacing of 0.3 mm.

EXAMPLE 2

Figure 2:
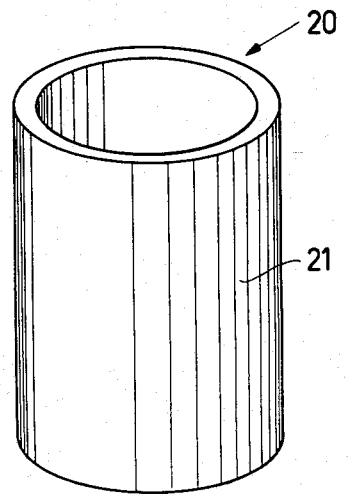
FIG. 2 is an elevation of a cylindrical cathode according to the invention.

A cylinder 20 shown in the elevation of FIG. 2 is turned from a tungsten body which has been made from pressed and sintered tungsten powder. A scandium oxide and alcohol-containing suspension is then provided by means of a brush on the outside 21 of the cylinder 20, an approximately 10 μm thick layer being obtained. The cylinder thus coated is then sintered at 1900° C., after which the cylinder cathode is impregnated with barium calcium aluminate via the inside. A heating element is then provided in the cathode. The resulting cathode had an emission which is comparable to the emission of the cathode of Example 1.

EXAMPLE 3

A cathode body which is pressed from pure tungsten powder is rubbed-in with scandium oxide powder (a porous 5–10 μm thick layer) before sintering at 1900° C. After sintering, the cathode is impregnated in the usual manner. Such a cathode again had very good emisson properties, approximately 100 $A/cm^2$ at 985° C. with a pulse load at 1000 V, measured in a diode arrangement with a cathode-anode spacing of 0.3 mm. The life of the cathode was longer than that of the scandium oxide-containing cathodes known so far. The cathode was not very sensitive to ion bombardment either.

EXAMPLE 4

Figure 3:
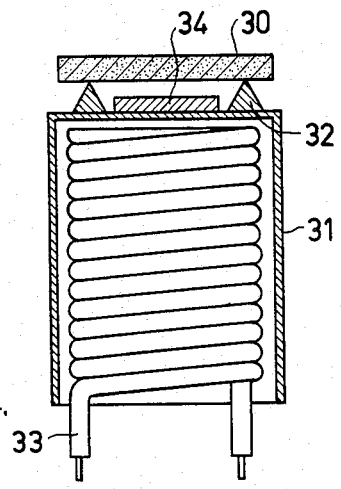
FIG. 3 is a longitudinal sectional view of an L-cathode according to the invention.

FIG. 3 is a longitudinal sectional view of an L-cathode according to the invention. A cathode body 30 is pressed from a mixture of 95% by weight of tungsten powder and 5% by weight of scandium oxide and is then sintered. This cathode body 30 is connected to a molybdenum cathode shaft 31 which has an upright edge 32. A cathode filament 33 is present in the cathode shaft 31. A store 34 of emissive material (for example barium calcium aluminate mixed with tungsten) is present in the hollow space between the cathode body 30 and the cathode shaft 31. This cathode had an emisson which is comparable to the emission of the Example 1 cathode and a longer life and a smaller sensitivity to ion bombardment than those of the scandium oxide-containing cathodes known so far.

What is claimed is:

1. In a dispenser cathode comprising a body having an emissive surface for emitting electrons from a barium containing emissive material included in the cathode;

the improvement comprising a 20–100 micrometer thick scandium-oxide-containing region of the body disposed immediately beneath said emissive surface.

2. A dispenser cathode as in claim 1 where the barium containing emissive material is disposed adjacent a surface of said body opposite from said emissive surface.

3. A dispenser cathode as in claim 1 where said barium containing emissive material is impregnated in said body.

4. A method of manufacturing a dispenser cathode comprising a body having an emissive surface and including scandium oxide material disposed immediately beneath said emissive surface, said method comprising the steps of:

(a) pressing a metallic powder to form the body;

(b) sintering the body;

(c) adding a layer of scandium oxide powder to the body;

(d) sintering the body; and thereafter (e) providing the cathode with a barium-containing emissive material.

5. A method as in claim 4 where the layer of scandium oxide powder is added by providing a scandium oxide suspension on the body of pressed metallic powder.

6. A method of manufacturing a dispenser cathode comprising a body having an emissive surface and including scandium oxide material disposed immediately beneath said emissive surface, said method comprising the steps of:

(a) pressing a metallic powder to form the body;

(b) adding a layer of scandium oxide powder to the body;

(c) sintering the body; and thereafter (b) providing the cathode with a barium-containing emissive material.

7. A method of manufacturing a dispenser cathode comprising a body having an emissive surface and including scandium oxide material disposed immediately beneath said emissive surface, said method comprising the steps of:

(a) pressing a metallic powder, which is mixed at least near said emissive surface with scandium oxide, to form the body;

(b) sintering the body; and (c) providing the cathode with a barium containing emissive material.

8. A method of manufacturing a dispenser cathode as in claim 7 where the body is pressed from a metallic powder which is mixed with scandium oxide only near said emissive surface, the pressed mixture forming a concentration of scandium oxide beneath the emissive surface of the body.

9. A method as in claim 7 or 8 where the amount of scandium oxide mixed with the metallic powder is approximately 2–15% by weight of the resulting mixture.

* * * * *